United States Patent [19]

McGourty et al.

[11] Patent Number: 4,548,523

[45] Date of Patent: Oct. 22, 1985

[54] PRECISION TAPE FEED AND GUIDE MECHANISM

[75] Inventors: Thomas K. McGourty; Lawrence F. McGourty, both of Pas Robles, Calif.

[73] Assignee: Varitronic Systems, Inc., Eden Prairie, Minn.

[21] Appl. No.: 587,184

[22] PCT Filed: Jan. 20, 1984

[86] PCT No.: PCT/US84/00096

§ 371 Date: Feb. 17, 1984

§ 102(e) Date: Feb. 17, 1984

[51] Int. Cl.[4] ..... B41J 13/03

[52] U.S. Cl. ..... 400/617; 400/48; 400/636; 400/641; 400/619

[58] Field of Search ..... 400/23, 25, 48, 611, 400/612, 617, 636, 619, 636.3, 641; 226/86; 178/42

[56] References Cited

U.S. PATENT DOCUMENTS

| | | | |
|---|---|---|---|
| 1,800,195 | 4/1931 | Porter et al. | 400/615.2 |
| 2,909,341 | 10/1959 | Kingsley | 226/186 X |
| 3,042,179 | 7/1962 | Stern | 400/641 X |
| 3,768,619 | 10/1973 | Lewis | 101/18 |
| 3,952,652 | 4/1976 | Hamisch, Jr. | 101/316 |
| 4,015,700 | 4/1977 | Paque | 101/288 X |
| 4,243,333 | 1/1981 | Bradshaw et al. | 400/134 X |

OTHER PUBLICATIONS

*IBM Tech. Disc. Bulletin,* by M. K. Bullock, vol. 22, No. 6, Nov. 1979, pp. 2230–2231, 400–636.

*Primary Examiner*—Paul T. Sewell

*Attorney, Agent, or Firm*—Merchant, Gould, Smith, Edell, Welter & Schmidt

[57] ABSTRACT

A precision tape feed and guide mechanism is disclosed. The guide includes a base plate (308) and a hold-down plate (314) with fingers (316, 318). A spring (345) biases the fingers against the tape (301) during printing. Actuation lever (330) which is pivoted on point (332) causes plate (314) to lift out of contact with the tape and permit its easy removal. Feeding or incrementation of the tape is accomplished by an incompressible roller (350) removably biased against roller (352) which includes a recessed portion (356) having an incompressible O-ring (354) residing therein and biased against roller (350) with a tape (301) therebetween.

10 Claims, 6 Drawing Figures

PRECISION TAPE FEED AND GUIDE MECHANISM

TECHNICAL FIELD

This invention relates generally to printing or typing equipment involved in the use of the pressure process of dry transfer impression onto an image carrying tape. Specifically, this invention is directed to a mechanism for handling the tape.

CROSS REFERENCE

This application hereby incorporates by reference the disclosure of our co-pending applications filed on even date herewith the following titles:

Print Disk Positioning System, Ser. No. 584,434, filed 2-17-84

Printing Mechanism, Ser. No. 608,050, filed 2-17-84

Ribbon Cassette, Ser. No. 592,018, filed 2-17-84

Tape Cassette with Supply Indicator, Ser. No. 598,554, filed 2-17-84

Electronic Tape Writing Machine, Ser. No. 587,318, filed 2-17-84

BACKGROUND OF THE INVENTION

In the field of commercial art, there is a significant need for a simple means of tranferring prefabricated letters or characters to a "paste up" sheet for later photographing or printing. A dry rub-on transfer letter process is well known. However, these materials are supplied in sheets and the transfer must be made very carefully to produce carefully aligned and spaced images. Machines were later developed which prepared such letters on a continuous tape and this solved many of the aligment problems. An example of such machine is shown in PCT publication No. WO82/03600 and in U.S. Pat. Nos. 3,912,064 and 4,243,333. Since the paste up may be used in an enlargement with high resolution printing, the spacing of the characters must be accurately controlled. Even small errors in spacing or kerning would be very apparent upon enlargement.

Prior art devices provide mechanical means for advancing the tape, such as U.S. Pat. Nos. 1,800,195 and 3,768,619. Unfortuntely, wear of the mechanism over time will cause slight changes in the forward incrementation of the tape and accuracy will not be maintained. The present invention overcomes this problem by providing a simple electromechanical system which uses a minimum of precision parts yet maintains constant tape feed incrementation even after the replacement of parts.

Furthermore, it is also essential to have a reliable tape holding mechanism to insure that the characters will be perfectly aligned in their vertical orientation. In addition, this alignment means must be capable of releasing the tape rapidly so that an automated printing mechanism can produce a stream of characters without impediment. The present invention also provides for such a tape guiding mechanism particularly well suited to automated printing machines.

BRIEF DESCRIPTION OF THE INVENTION

According to one aspect of the invention, there is disclosed a tape feed mechanism for incrementally feeding an image-carrying tape through a printing station, including a first generally incompressible roller aligned to advance the image-carrying tape; a second roller, parallel and adjacent to the first roller, for biasing the tape against the first roller; means for releasably biasing the rollers in contact with each other to engage the tape therebetween, the second roller having side edges including circumferential and generally incompressible surface having a circumferential recess therein between the edges, at least one compressible O-ring being fitted onto said recess so that first roller and O-ring contact the tape when the biasing means in engaged. According to another aspect of the invention, a tape feed mechanism for incrementally feeding an image-carrying tape through a printing station is disclosed having a stationary guide member affixed to a support having a longitudinal recess sized to receive the tape, the guide being positioned in the printing station, a second guide member being pivotally mounted adjacent the stationary guide and having hold down fingers operable to overlie the tape when it is in the recess and to be pivotally liftable from the tape.

Various advantages and features of novelty which characterize the invention are pointed out with particularity in the claims annexed hereto and forming a part thereof. However, for a better understanding of the invention, its advantages, and objects obtained by its use, reference should be had to the drawings which form a further part hereof, and to the accompanying descriptive matter, in which there is illustrated and described a preferred embodiment of the invention.

BRIEF DESCRIPTION OF THE DRAWINGS

The present invention can be more clearly understood by reference to the following detailed description read in connection with the drawings, wherein like reference numerals refer to like elements throughout, wherein.

DETAILED DESCRIPTION OF THE PREFERRED EMBODIMENTS

Figure 1:
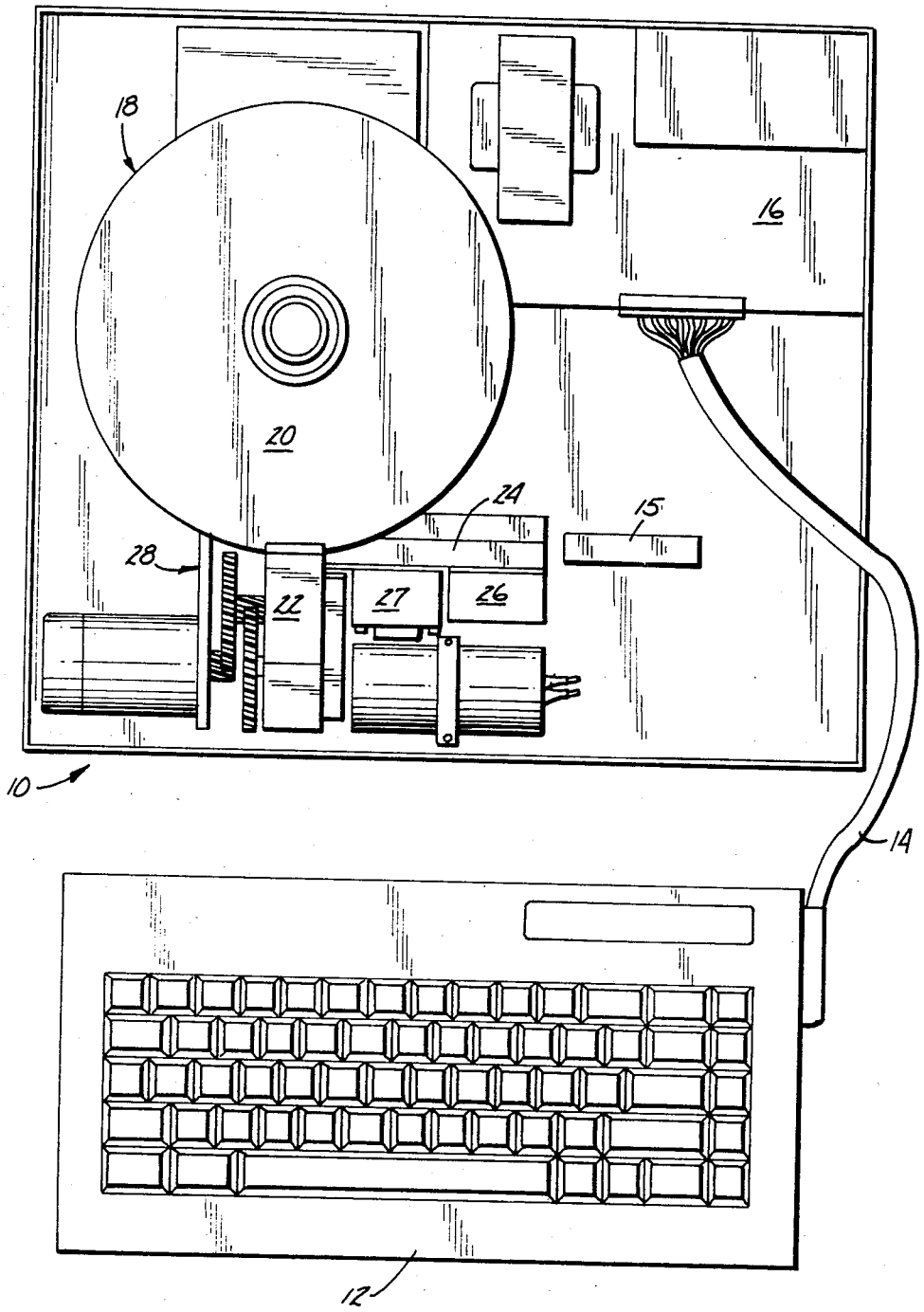
FIG. 1 is an overall plan view of a preferred embodiment of the invention in a typical working environment.

To understand a possible implementation of the present invention in a larger printing system, reference should be had to FIG. 1 which shows an overall environmental view of the system in which the invention is preferably employed. FIG. 1 shows an electronic tape writing machine 10 having a keyboard 12 which is connected by a cable 14 to an electronics section 16. Signals from the keyboard are interpreted by the electronics section 16 which causes the print disk positioner 18 to locate the print disk 20 in an appropriate position within the jaws of the impact printing device 22, which holds a carrier tape 15 and a carbon-like material 24. The material is advanced by the precision tape feed and guide mechanism 26 and may later be cut by tape cutting device 28.

In the preferred embodiment, the print disk 20 would be positioned with the appropriate raised (or depressed) character in alignment with the impact printing device 22. The printing action is accomplished by device 22 which causes the print disk 20, carrier tape 301, carbon material 24, and a print hammer to be brought rapidly in contact with each other, thereby transferring the image from the disk to the carbon material which adheres to the tape 301. The tape 301 is then advanced as desired by the precision tape feed and guide mechanism 26, as will be explained hereinafter. Finally, the tape is cut when the job is completed.

Figure 2:
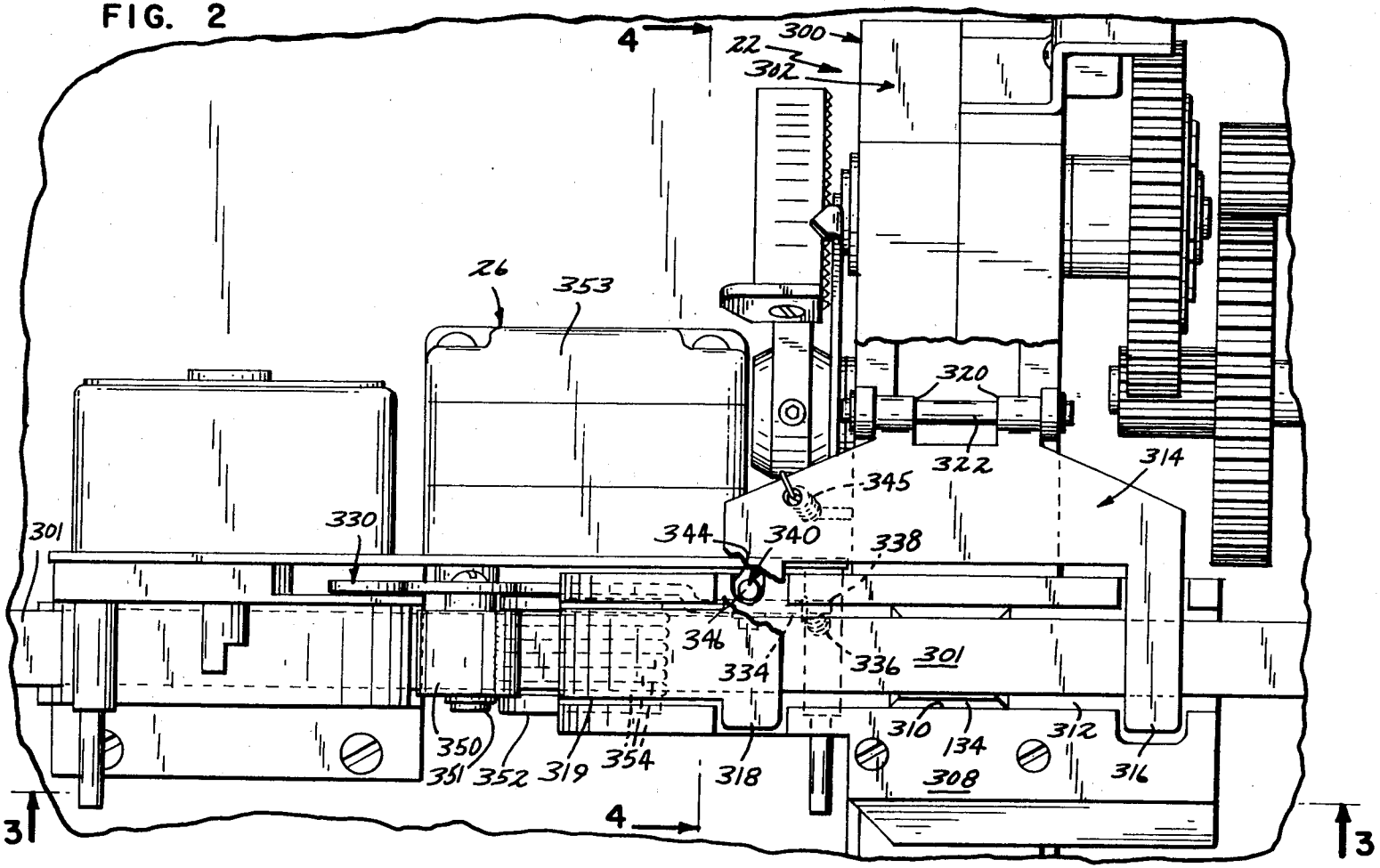
FIG. 2 is a fragmentary top plan view of a preferred embodiment of the present invention.
Figure 3:
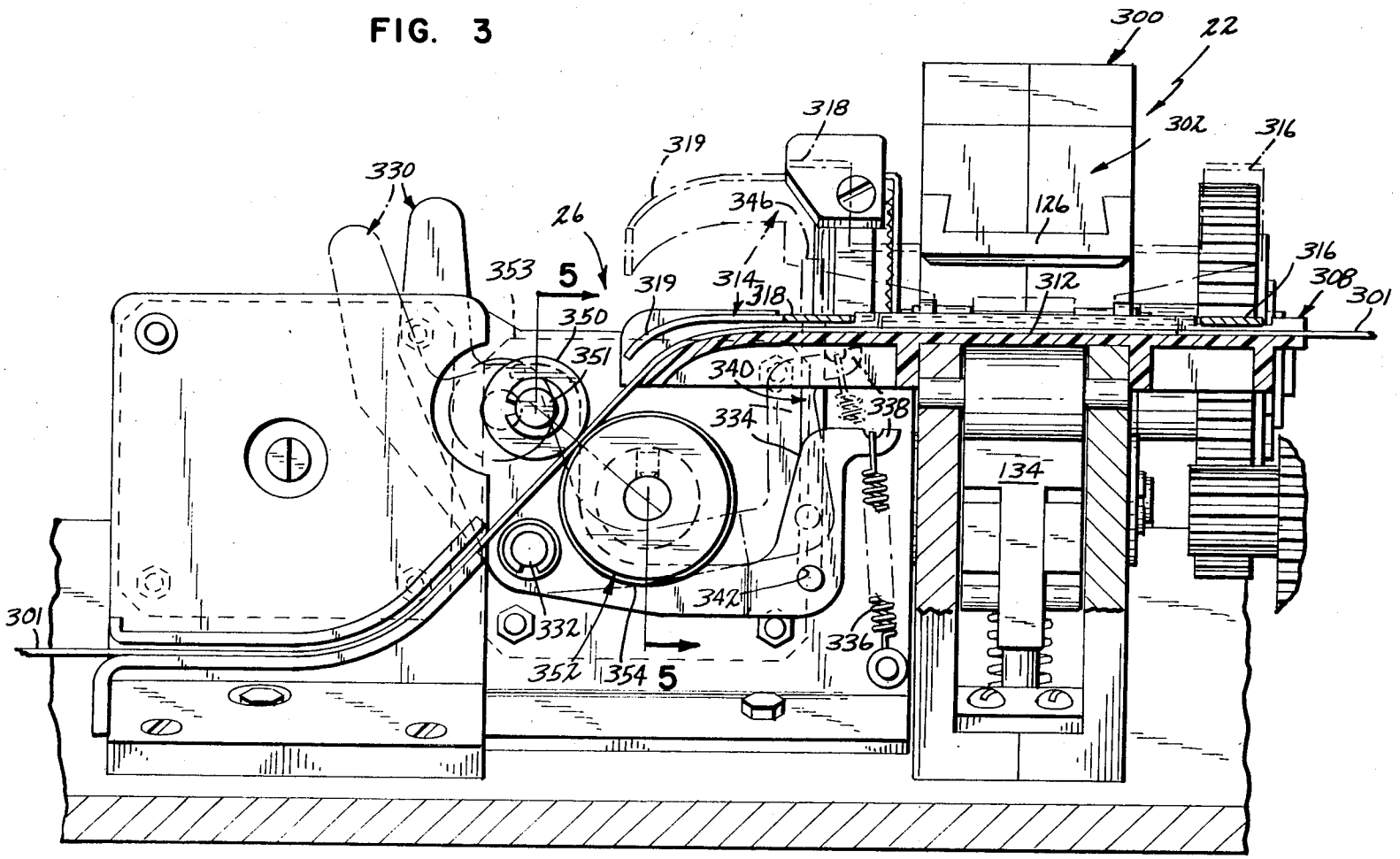
FIG. 3 is a view taken along lines 3—3 of FIG. 2.

Turning to FIGS. 2 and 3 where the preferred embodiment is most clearly shown, the printing station 300 includes a printing mechanism 302 which is fully described in our copending application entitled PRINTING MECHANISM previously cited herein. This device employs an impact hammer 134 which strikes toward anvil 126 causing the print disk 20 to transfer pigment from the carbon-like ribbon (not shown) onto the carrier tape 301. To hold the tape in longitudinal alignment as it passes the print station (to insure vertically aligned characters) is a tape guide 308 which has an aperture 310 sized to permit the hammer 134 to pass therethrough. The guide 308 also includes a recessed region 312 which is just wide enough to accomodate the width of the tape and thereby hold it in alignment.

In order to hold the tape flat within the recess 312 during printing, a hold-down member 314 having fingers 316, 318 is provided. Member 314 is pivotally attached by a hinge 320 and a pivot pin 322 at the back of the mouth of the printing station. When hold-down member 314 is operational, it will overlie the tape with the fingers 316, 318.

Extending off finger 318, is a curved portion 319 (shown in FIG. 3) which follows the curvature of plate 308 and assists in feeding the tape in the direction desired. The guide block 308 includes a pair of recesses 324, 326 located to accept the fingers 316, 318 and permit them to touch the tape and assert a force thereon. When the tape is threaded, it is necessary to lift the hold-down mechanism to permit easy threading in the print station. This is accomplished by a lift mechanism shown most clearly in FIGS. 3 and 4. A lift arm 330, which is generally U-shaped, is pivoted at its lower point on a pivot shaft 332 when the arm is actuated (in FIG. 3 that means pushed to the left), the pivot point causes are portion 334 of arm 330 to rise upward against the force of bias spring 336 (FIGS. 3 and 4) which is held within a hook portion 338 of the arm. This action in turn causes a drive pin 340 which is engaged at one end within aperture 342 on the arm 330 to pass upward through a guiding aperture 344 (shown most clearly in FIG. 2) and engage a portion of plate 314 at its other end 346. Although in this embodiment, lever 330 is shown mechanically operated, it could likewise be electromechanically operated from the keyboard 12 of the overall system.

Figure 4:
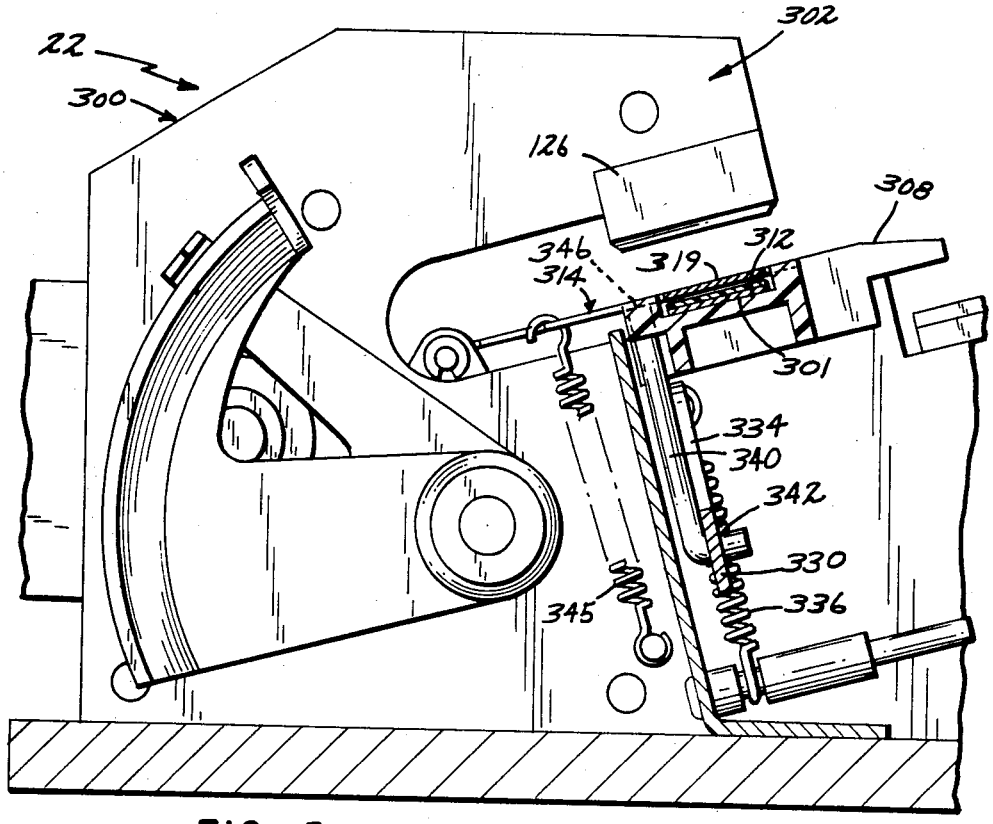
FIG. 4 is a view taken along lines 4—4 of FIG. 2.

As shown in FIG. 4, spring 345 which engages plate 314 at one end and is mounted on the printing station at the other, maintains plate 314 and likewise fingers 316, 318 overlying the tape.

Before the tape has been guided through the print station, it comes in contact with the precision tape feed or incrementation section. This includes a generally incompressible roller 350 which rotatably rides on a shaft 351 attached to lever arm 330 and thus can be pivoted away from the tape when the arm 330 is actuated. The feed also includes a second roller 352 aligned in parallel and adjacent to the first roller and being driven by a stepper motor 353 (shown in FIG. 2).

Figure 5:
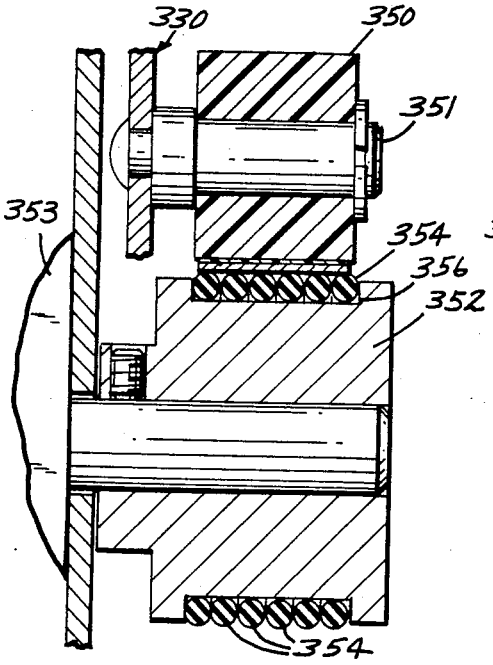
FIG. 5 is a view taken along lines 5—5 of FIG. 3.

The driven roller 352 is shown in detail in FIGS. 5 and 5, with FIG. 5 being the preferred embodiment. Roller 352 is generally made of a hard material and has a circumferential recess 356 preferably equal to or greater than the width of the tape. Within the recess is placed a plurality of neoprine O-rings 354. The rings are such that they extend over the depth of recess 356, or looking at it the other way, the recess is shallower than the cross-sectional diameter of the O-rings. Neoprine or other like material is chosen since it is possible to manufacture such rings with high precision so that roller 352 will have a known outside diameter (including the rings) from machine to machine. Furthermore, when the O-rings require replacement, the incrementation of the machine will not be substantially altered. It can be appreciated that small variances in the diameter of the O-ring will not have as significant an effect on the incrementation or feeding of the tape as would small variances of the diameter of roller 352. Thus, in the present invention, accuracy from machine to machine and after replacement of the O-rings is maintained because the roller 352 is never replaced. Furthermore, it is quite simple to replace the O-rings without disassembly of the machine which could further cause misadjustment thereof.

Advancement of the tape is, of course, accomplished by incrementation of the step or motor 353.

In the alternate embodiment, roller 352 is shown as **352*a* and differs only in that recess 356*a* is deeper than in the embodiment shown in FIG. 5. This provides the advantage that the tape and roller 350 may reside within the depressed region 356*a*** and maintain the tape in an accurately formed channel.

Although some specific embodiments of the present invention have been shown, those skilled in the art will perceive modifications which can be made without departing from the spirit of the invention. Therefore, it is intended that the scope of the present invention be dictated by the appended claims rather than by the description of the embodiment.

We claim:

1. A tape feed mechanism for incrementally feeding an image carrying tape through a printing station or a printer comprising:

a first generally imcompressible roller aligned to advance an image carrying tape, a second roller in parallel with and adjacent to said first roller, means for releasably biasing said rollers together to engage the tape therebetween, said biasing means including a generally U-shaped arm having first and second portions connected at one end by a third connecting portion, said first portion including an actuation lever at one end and a pivot point generally toward the other end, said pivot being affixed to said printer so that said arm rotates about said point, means rotatably affixing said first roller to said one of said portions and being positioned to move in and out of contact with said second roller, bias means connected to said U-shaped member for biasing said first roller into contact with said second roller, a tape guide plate affixed to said printing station having a groove therein sized to receive the tape, a hold-down member hingeably attached to said guide plate for maintaining the tape between the plate and hold-down member, connecting means extending between said U-shaped arm and said hold-down member and positioned so that actuation of the arm simultaneously draws said rollers out of contact with each other and lifts said hold-down plate away from said guide plate.

2. A mechanism according to claim 1 wherein said first portion includes said lever and second second portion includes means for attachment of said bias means.

3. A mechanism according to claim 1 wherein said connecting means includes a push rod.

4. A mechanism according to claim 1 wherein said hold-down plate includes a pair of hold-down fingers oriented transverse of said groove and located one on each side of said printing 5. A tape feed mechanism for incrementally feeding an image carrying tape through a printing station comprising:

a stationary guide member affixed to a support having a longitudinal recess sized to receive said tape, said guide member beng positioned in the printing station, a second guide member being pivotally mounted adjacent said stationary guide and having hold-down fingers operable to overlie the tape when it is in said recess and to be pivotally liftable from the tape, a first roller aligned to advance the tape, a second roller in parallel with and adjacent to said first roller, means releasably biasing said rollers in contact with each other to engage the tape therebetween, said biasing means including lever means for lifting said fingers of said second guide member from the tape, said lever means including a pivot connected to said support, first and second portions on either side of the pivot, said first portion being operatively connected to the second guide and being aligned to lift said fingers when said first portion is actuated.

6. A tape feed mechanism for incrementally feeding an image carrying tape through a printing station comprising:

a stationary guide member affixed to a support having a longitudinal recess sized to receive said tape, said guide member being positioned in the printing station, a second guide member being pivotally mounted adjacent said stationary guide and having hold down fingers operable to overlie the tape when it is in said recess and to be pivotally liftable from the tape, a first generally incompressible roller aligned to advance the tape, a second roller in parallel with and adjacent to said first roller, means releasably biasing said rollers in contact with each other to engage the tape there-between, said second roller having side edges including a circumferential generally incompressible surface having a circumferential recess therein, between said side edges at least one compressible O-ring being fitted into said recess so that said first roller and said O-ring contact the tape when biasing means is engaged, said biasing means including lever means for lifting said fingers of said second guide member from the tape, said lever means including a pivot connected to said support, first and second portions on either side of the pivot, said first portion being operatively connected to the second guide and being aligned to lift said fingers when said first portion is actuated.

7. A mechanism according to claim 6 wherein said first roller is rotatably affixed to said lever means so that actuation of the first portion will simultaneously withdraw said first roller and said fingers from the tape.

8. A mechanism according to claim 6 wherein the depth recess is less than the cross-sectional dimension of the O-ring.

9. A mechanism according to claim 6 wherein the depth of said recess is generally one-half the cross-sectional dimension of the O-ring.

10. A mechanism according to claim 8 wherein said O-ring is made of neoprene.

* * * * *

UNITED STATES PATENT AND TRADEMARK OFFICE

CERTIFICATE OF CORRECTION

PATENT NO. : 4,548,523

DATED : October 22, 1985

INVENTOR(S) : Thomas and Lawrence McGourty

Figure 6:
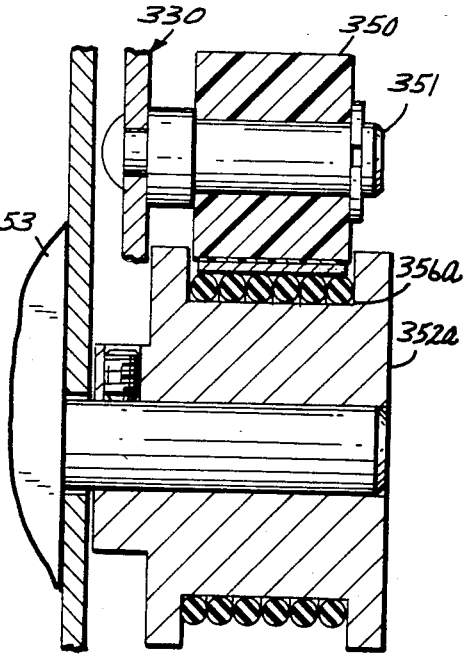
FIG. 6 is an alternate embodiment of the subject matter in FIG. 5.

It is certified that error appears in the above-identified patent and that said Letters Patent is hereby corrected as shown below:

Column 1, line 7, "the pressure" should be --a pressure--;

Column 1, line 35, "aligment" should be --alignment--;

Column 1, line 44, "Unfortuntely" should be --Unfortunately--;

Column 2, line 7, "in engaged" should be --is engaged--;

Column 2, line 15, "hold down" should be --hold-down--;

Column 2, line 21, "thereof" should be --hereof--;

Column 3, lines 65 and 66, "FIGS. 5 and 5" should be --FIGS. 5 and 6--;

UNITED STATES PATENT AND TRADEMARK OFFICE

CERTIFICATE OF CORRECTION

PATENT NO. : 4,548,523

DATED : October 22, 1985

INVENTOR(S) : Thomas and Lawrence McGourty

It is certified that error appears in the above-identified patent and that said Letters Patent is hereby corrected as shown below:

Column 4, line 51, "said pivot being" should be --said pivot point being--;

Column 5, line 2, "and second second portion" should be --and second portion--;

Column 5, line 9, "said printing" should be --said printing station.--;

Column 5, line 15, "beng" should be --being--;

Column 6, line 4 and 5, "hold down" should be --hold-down--.

Signed and Sealed this

*Fourth* Day of *March 1986*

[SEAL]

*Attest:*

DONALD J. QUIGG

*Attesting Officer* *Commissioner of Patents and Trademarks*